US005664617A

United States Patent [19]

Patton et al.

[11] Patent Number: 5,664,617

[45] Date of Patent: Sep. 9, 1997

[54] SOW LIFTER

[75] Inventors: Russell D. Patton; Delbert A. Beckstrand, both of Goldendale, Wash.

[73] Assignee: Columbia Aluminum Corporation, Goldendale, Wash.

[21] Appl. No.: 410,352

[22] Filed: Mar. 24, 1995

[51] Int. Cl.[6] ..... B22D 29/00; B66C 1/02

[52] U.S. Cl. ..... 164/269; 164/412; 294/2; 294/64.1

[58] Field of Search ..... 164/269, 412; 294/2, 64.1, 81.61

[56] References Cited

U.S. PATENT DOCUMENTS

| | | | |
|---|---|---|---|
| 2,783,078 | 2/1957 | Billner | 294/2 X |
| 3,159,418 | 12/1964 | Hansen | 294/2 |
| 3,306,646 | 2/1967 | Flora, Jr. | 294/2 |
| 3,627,369 | 12/1971 | Nixon . | |
| 3,640,562 | 2/1972 | Creskoff . | |
| 3,651,957 | 3/1972 | Ball et al. . | |
| 3,785,691 | 1/1974 | Sperry . | |
| 3,910,620 | 10/1975 | Sperry . | |
| 4,708,381 | 11/1987 | Lundback . | |
| 4,759,124 | 7/1988 | Snyder et al. . | |
| 4,828,304 | 5/1989 | No et al. . | |
| 4,852,926 | 8/1989 | Littell . | |
| 5,207,465 | 5/1993 | Rich . | |
| 5,282,659 | 2/1994 | Yasuraoka et al. . | |
| 5,375,895 | 12/1994 | Volkert . | |

FOREIGN PATENT DOCUMENTS

| | | | |
|---|---|---|---|
| 1071562 | 2/1984 | U.S.S.R. | 294/2 |
| 1364592 | 1/1988 | U.S.S.R. | 294/2 |

OTHER PUBLICATIONS

English translation of U.S.S.R. Inventor's Certificate 1071562 Published Feb. 7, 1984.

English translation of U.S.S.R. Inventor's Certificate 1364592 Published Jan. 7, 1988.

Original folder from Acme Machine Works, Inc. including a photograph of a prior art sow train; undated.

Undated photocopy of Pyrotek brochure entitled "Ropes & Tadpoles Materials for Door Seals and Gaskets" describing prior art tadpole materials.

*Primary Examiner*—J. Reed Batten, Jr.

*Attorney, Agent, or Firm*—Klarquist Sparkman Campbell Leigh & Whinston

[57] ABSTRACT

A sow lifter includes a vacuum hood with a gasket which establishes a seal between the hood and a sow to be lifted from a mold. Preferably, the gasket is of a circular cross section before use and includes a core of a first material surrounded by a high temperature resistant fabric. The gasket is detachably mounted to the vacuum hood. A sow gripper may be provided and may take the form of fluid cylinder actuated arms with sow gripping elements. The gripping elements are shiftable from a first position in which the elements are not positioned beneath a lifted sow to a second position in which the gripping elements are at least partially positioned beneath the sow. The sow lifter is preferably utilized in combination with a sow train to facilitate the cyclical removal of at least partially solidified sows from cars or molds in the train as such molds pass a sow removal location.

19 Claims, 4 Drawing Sheets

SOW LIFTER

BACKGROUND OF THE INVENTION

The present invention relates to an apparatus for lifting a sow from a mold and more specifically to such an apparatus which employs a vacuum in removing the sow. A sow is an extremely heavy block of metal that is cast into a mold and which is typically at a relatively high temperature when it is removed from a mold.

In a metal purification and casting operation, molten metal is typically poured into a mold and then allowed to solidify. The mold is often coated with a mold release material to facilitate removal of the cast sow or block of metal following casting. Because the molds are typically reused and need to be made available more quickly for a subsequent pouring and sow removal cycle, the temperature of the sows can be near the melting point of the metal at the time of sow removal. To assist in the solidification of at least an outer shell of the sow, molds and the molten metal are commonly sprayed with water or are otherwise cooled to accelerate the solidification of the metal.

In a known approach, a plurality of molds are interconnected in a sow train or wheel with the molds traveling on a track. The molds travel between a sow pouring location, at which the mold is filled with molten metal, a sow removal location, at which the solidified sow is removed from the mold, and back to the sow pouring location. It is not unusual for the plurality of molds to be interconnected in the form of an endless loop of cars which travel along a track between these locations or on a rotating wheel.

In one conventional approach for removing sows from a mold, each mold is inverted as it reaches a sow removal location to dump the sow from the mold. The sow is then returned to its upright position for movement, such as by a forklift, to a sow stacking or collecting location. In the case of sows of aluminum, it is not unusual for a cast sow to weigh between 1200 pounds and 1500 pounds. In addition, it is not unusual for an aluminum sow to be at a temperature of 500° F. to 700° F., or higher, at the time the sow is removed from the mold. Consequently, to the extent sows need to be turned over for subsequent handling, the risk of a worker being. inadvertently burned by coming into contact with the sow is increased. Also, the step of inverting or tilting a mold to eject a sow requires mold tilting equipment and can add to the time required to remove a sow and return a mold into position for a subsequent metal pour cycle.

In another approach for removing sows from a sow train, keys are positioned in a mold before molten metal is poured. These keys are typically positioned adjacent to a wall of the mold and are partially embedded in the sow during casting. Following solidification of a sow, the keys are removed to leave tong receiving pockets in the sow. The combination of pockets formed by these keys provide a gripping location for tongs which are used to remove the sow from the mold. The tongs are typically coupled to a hoist or overhead crane which lifts the tongs and sow from the mold. Typically, sledge hammers are used to beat the keys free from the sow prior to using the tongs. It is extremely noisy to use sledge hammers to knock the keys free. In addition, workers using sledge hammers are in close proximity to the hot sows and thus are at risk of being burned even though relatively expensive safety garments and gloves are worn to help reduce this risk.

One aluminum manufacturing company is understood to have used a vacuum for lifting a sow from a mold. Initially, a low temperature seal was understood used in an attempt to establish a seal between the lifting device and the sow. To cool the sow to the point where the low temperature gasket would not be damaged by the high temperatures involved, the temperature of the sow was reduced prior to sow removal. As a result, cooling water used in solidifying the sow would tend to remain in the mold and not totally evaporate as the mold in a sow train reached the pouring location. Molten aluminum poured into water causes the rapid expansion of steam and spattering of aluminum, risking injury and damage. It is also understood that this aluminum manufacturing company is now utilizing a different gasket material, namely multiple layers of a silicon and fiberglass material stacked to form a gasket of a square or rectangular cross section in combination with a vacuum device to lift a sow from a mold. This gasket material allows the sow to be removed at higher temperatures. However, to form a seal with the upper surface of a sow when such a gasket is used, it is understood that this company requires equipment or operates a sow train to solidify a sow in a manner that reduces surface variations normally present in the upper surface of a solidified sow. Although the exposed upper surface of a partially solidified sow in a mold appears to be quite uniform and planar, in the absence of such equipment or process step, typically the upper sow surface has variations of from one-quarter to three-quarters of an inch or more from a horizontal plane.

In these prior art approaches, if a lifted sow should slip, workers are exposed to a risk of injury, due to the weight of the sow and/or the high temperature of the sow.

Thus, a need exists for an improved sow lifter which is directed toward overcoming the above and other limitations and disadvantages of the prior art.

SUMMARY OF THE INVENTION

According to one aspect of the present invention, an improved sow lifter has a vacuum hood, which may be in the form of a plate, with a lower working surface. A high temperature resistant compressible gasket is supported in a position to establish a seal between the lower working surface of the hood and a sow which is to be lifted. In a specifically preferred embodiment, the gasket is initially of a circular cross section with a diameter of at least one and one-half inches so as to effectively establish a seal between the uneven exposed surface of a sow and the working surface of the vacuum hood during a sow lifting operation. The gasket deforms during use from its initial circular cross section. A specifically preferred form of gasket includes a core covered with a high temperature resistant covering layer. A most preferred gasket has a core in the form of a fiberglass rope with a fabric material covering of graphite coated fiberglass. A vacuum hood mover is operable to move the hood to a sow lifting position in which the gasket is sealed against the sow and to a raised position to which the sow is lifted from the mold. The vacuum hood mover is also preferably operable to transport the lifted sow to a sow collection location which is spaced some distance from the mold.

In accordance with another aspect of the invention, the vacuum may be established between the working surface of the vacuum hood and the sow in any convenient manner such as utilizing a vacuum pump. However, a specifically preferred apparatus for establishing the vacuum includes a jet pump coupled to the vacuum hood. A muffler may be utilized to muffle the sound of air exiting the jet pump.

As another aspect of the present invention, a mechanical assembly is preferably provided for gripping a sow which has been lifted from a mold utilizing a vacuum. By providing this assembly, which may take the form of a sow gripper, the lifted sow is retained by the sow gripper in the lifted position in the event the vacuum is inadvertently relieved. In this case, the sow gripper functions as a safety mechanism to minimize the risk of a lifted sow falling to the ground where it may crush or burn a worker. Alternatively, as the sow gripper grips a lifted sow, the vacuum may be intentionally relieved with the sow gripper then being the sole or primary mechanism for carrying the sow from the mold to a sow collection location where the sow is deposited. However, most preferably the sow gripper is used in combination with the vacuum lifting mechanism when a sow is being lifted and moved.

The preferred form of sow gripper is coupled to the vacuum hood either directly or through a frame and is shiftable from a first position at least partially beneath a sow which has been lifted from a mold to a second position in which the sow gripper is not positioned beneath the lifted sow. In a specific embodiment, the sow gripper comprises plural sow catching or gripping arms pivotally coupled to the vacuum hood in combination with an actuator coupled to the arms. The arms also include sow gripping elements. The actuator is operable to allow the arms to pivot between a first or gripping position which places the sow gripping elements at least partially beneath the sow and to pivot the arms to a second or release position in which the sow gripping elements are not positioned beneath the sow. The sow gripper thus prevents a lifted sow from falling until such time as the sow gripping elements are moved to the second or release position.

In the specifically preferred form of sow gripper, the arms and sow gripping elements are allowed to fall, under the influence of gravity, to the sow gripping position. This may occur automatically, such as upon application of the vacuum tothe vacuum hood. As the sow is lifted from the mold, the sow gripping elements engage and lock the sow into position. When the sow is lowered onto a stack of sows or another support, pressure on the sow gripper is automatically relieved, permitting the sow gripper to be raised to its sow release position.

In the illustrated preferred embodiment of the present invention, the actuator includes a respective lever coupled to each arm and a fluid actuating cylinder coupled to each lever. The cylinder is extendable and retractable in response to fluid pressure. The associated gripping arm shifts between the first sow gripping and second sow release positions in response to fluid pressure.

As yet another aspect of the present invention, the sow lifter includes a frame which is connected to the vacuum hood and the sow gripper. The frame preferably includes guides projecting outwardly and downwardly relative to the vacuum hood. These guides assist in positioning the sow lifter over a sow in a mold. That is, in operation, the illustrated guides pass downwardly along the outer perimeter of the mold, thereby centering the working surface of the vacuum hood directly over the upper surface of a sow to be lifted.

The sow lifter may be mounted to a track or other guide mechanism for travel between the sow lifting location and a sow collecting location. In addition, a hoist or other lifting device is utilized to raise and lower the vacuum hood during the lifting operation.

As yet another aspect of the present invention, the gasket is preferably detachably mounted to the vacuum hood. Due to the harsh environmental conditions under which the vacuum hood is operated, the gaskets are subjected to extensive wear and thus their easy replacement is important. In the illustrated embodiment, a clamping rim or other retainer is used to clamp a portion of the gasket to the working surface of the hood to hold the gasket in place. Bolts or other mechanical fasteners are used to mount the retainer and clamped gasket in place.

In addition, the present invention relates to a sow lifting apparatus in combination with a sow train.

It is accordingly one object of the present invention to provide an improved sow lifter.

Yet another object of the present invention is to provide an improved sow lifter utilizing a vacuum for removing a sow from a mold and providing an auxiliary sow gripping mechanism or assembly.

A still further aspect of the present invention is to reduce the risk of contact by workers with a high temperature sow during the removal of a sow from a sow mold.

Yet another object of the present invention is to provide an effective seal for a vacuum assisted sow lifter, the seal being established between a working surface of the sow lifter and an uneven exposed surface of a sow in a mold.

A still further object of the present invention is to provide a sow lifter which is capable of lifting relatively heavy sows which are at a relatively high temperature.

The present invention relates to the above features and objects individually as well as collectively. These and other objects, features and advantages of the present invention will become apparent to those skilled in the art from the following description and drawings.

DETAILED DESCRIPTION OF THE PREFERRED EMBODIMENT

Figure 1:
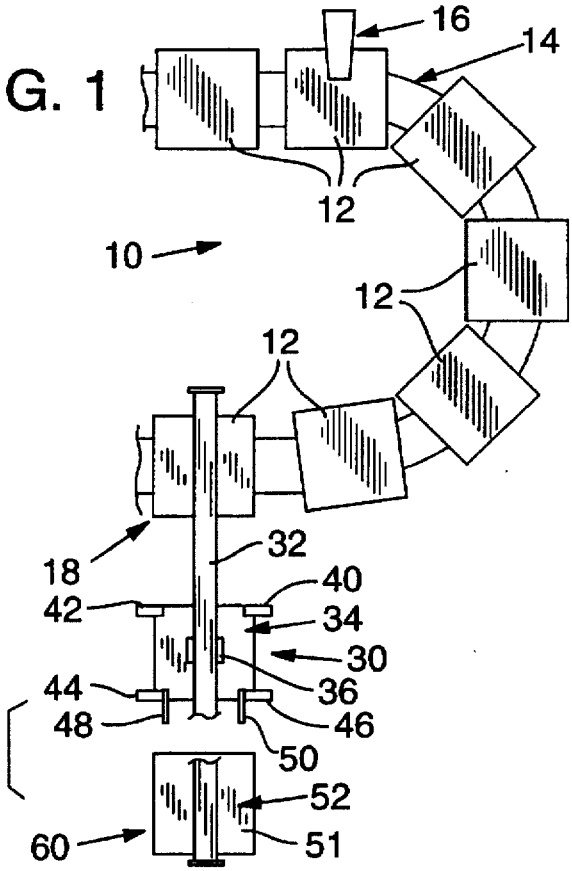
FIG. 1 is a top plan view, in schematic form, of a sow lifter in accordance with one embodiment of the present invention in combination with a sow train.

With reference to FIG. 1, a portion of a sow train 10 is illustrated schematically and includes a plurality of molds in the form of cars 12 which travel along a track 14 in an endless loop, only a portion of the loop being shown in FIG. 1. One exemplary sow train is manufactured by Acme Machine Works, Inc. of Spokane, Wash. As the cars 12 travel along the track, they pass a molten metal pouring location 16, represented by a schematic illustration of a spout. At location 16, molten metal is poured into the interior of the car which defines a mold for a sow. As the car continues to travel, the car and molten metal are typically sprayed with water to cool the metal and facilitate solidification of the metal into the sow. Eventually, the car travels along the track to a sow removal location indioated generally at 18. At location 18, a sow lifting apparatus in accordance with the present invention is used to remove the sow from the car 12. As previously mentioned, if molten aluminum is being poured, it is not unusual for a sow of aluminum to weigh between 1200 pounds and 1500 pounds, with a weight of between 1400 pounds and 1450 pounds being a more specific example. Aluminum typically becomes molten at 1100° F. and is poured ata temperature above this magnitude. At the time an aluminum sow reaches the sow removal location, the surface temperature at the exterior of the sow is typically 700° F. or higher. In addition, the interior-most portion of the sow may still be molten metal at the time of sow removal.

Following removal of the sow, the now empty car 12 travels along the track toward the pour location 16. Between the sow removal and sow pour locations, any water that has been deposited in the mold evaporates due to the high temperature of the mold and may be assisted by gas burners. In addition, a mold release material is sprayed or otherwise deposited into the mold before molten metal is again poured.

As a sow containing car or mold 12 reaches the sow removal location, a sow lifter 30 is in a position or positioned above the car and is lowered into contact with the sow. A vacuum seal is established between the sow lifter and sow. As a result, the sow lifter raises the sow from the car 12 as the sow lifter is raised. As explained more fully below, a sow gripper is also provided as an option for gripping the sow as it is lifted from the mold.

The sow lifter 30 is preferably suspended from a track, such as a monorail 32, along which the sow lifter is moved into position. The sow lifter may be manually moved along the track, or its movement may be automated and driven by a motor under suitable controls.

As shown schematically in FIG. 1, the sow lifter includes a vacuum hood 34 which is sealed against the upper surface 51 of a sow 52 during the sow lifting operation. A hoist 36, shown schematically in FIG. 1, is utilized for raising and lowering the sow lifter, although other raising and lowering mechanisms are equally suitable. Guides are provided which project outwardly and downwardly from the vacuum hood 34. These guides pass along the outer periphery of the car 12 and assist in centering or locating the vacuum hood over the sow. Exemplary guides are numbered 40–50 and are shown schematically in FIG. 1. Suitable guides are described in greater detail below. The lifted sow is moved from the sow removal location to a sow collection location indicated at 60. At the sow collection location, the sow is lowered and released. Plural sows are typically stacked, with the stack of sows then being moved by a forklift or other load handling equipment for subsequent shipment or use.

In this manner, the present invention operates in combination with a sow train. Alternatively, the invention may be used in removing sows from individual molds or other mold systems which are not associated with a sow train.

Figure 2:
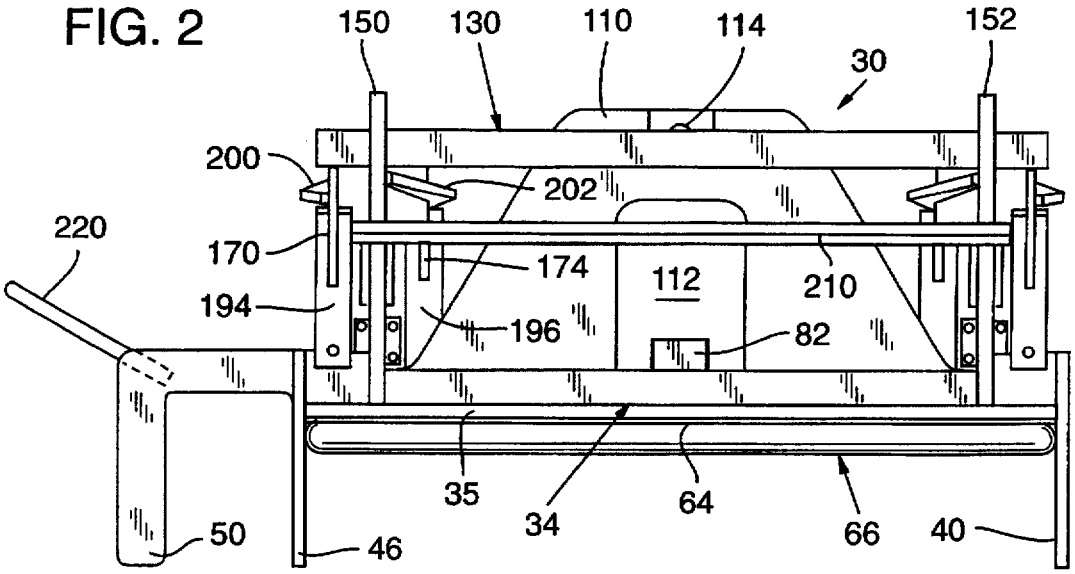
FIG. 2 is a side elevational view of one form of a sow lifter of the present invention with a vacuum establishing mechanism removed for clarity.
Figure 4:
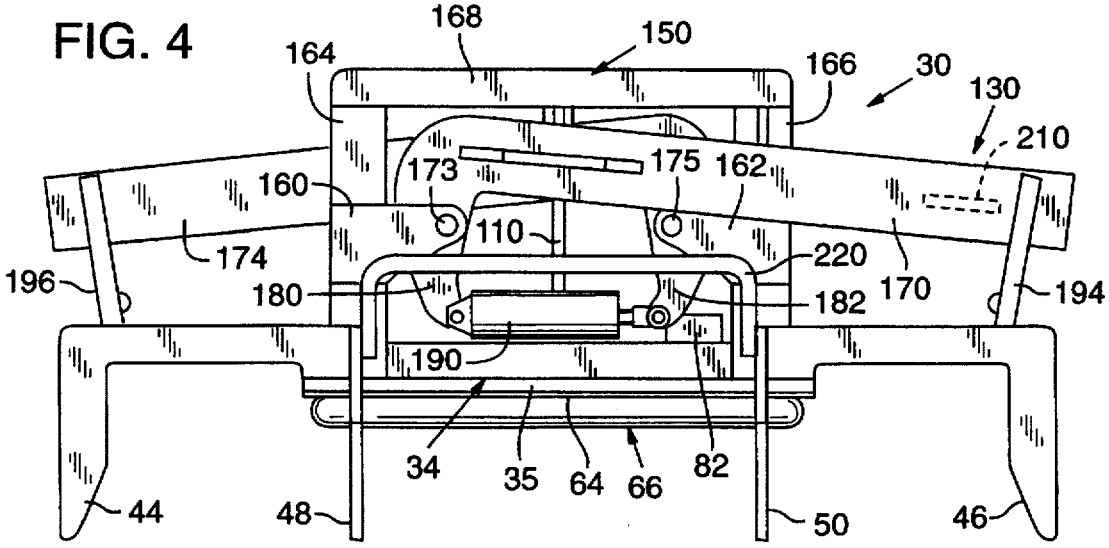
FIG. 4 is an end view of the sow lifter of FIG. 2.
Figure 3:
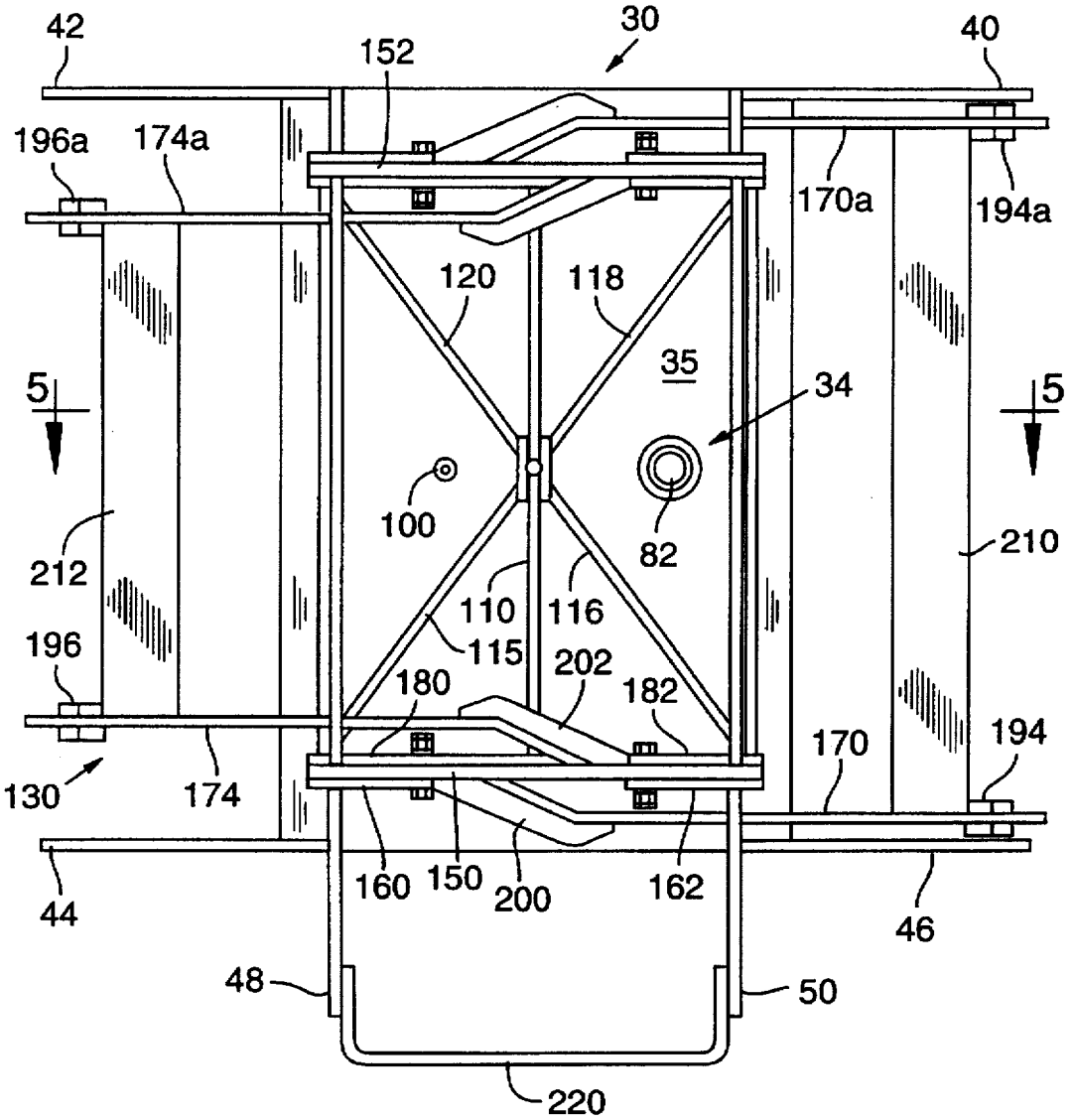
FIG. 3 is a top plan view of sow lifter of FIG. 2.

With reference to FIGS. 2–4, although the vacuum hood 34 may assume any convenient shape, such as an inverted concave or cup shape, the illustrated vacuum hood comprises a flat plate 35 with a lower working surface 64. Plate 35 is typically of a rigid high temperature resistant material, such as steel. A high temperature resistant compressible gasket 66 is coupled to the vacuum hood, and is preferably mounted to the working surface of the plate 35, in a position to establish a seal between the sow lifter 30 and the sow 52 when the sow lifter is brought into contact with the sow. By high temperature resistant gasket, it is meant a gasket which is capable of operating at temperatures between 700° F. and 1100° F. or higher.

Figure 7:
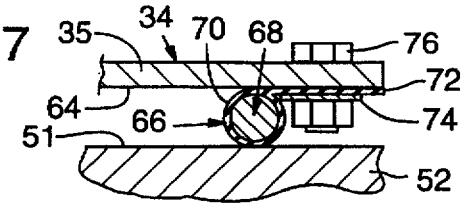
FIG. 7 is an enlarged sectional view of one preferred form of gasket utilized in the sow lifting apparatus of the present invention.

In a preferred form, the preferred gasket is initially generally circular in cross section as shown in FIG. 7 and has a core 68 of a first material surrounded by a second high temperature resistant material 70. Although other materials may be used, a specifically preferred example of gasket material includes a core 68 of a twisted rope of fiberglass surrounded by a fabric 70 of fiberglass which is coated with graphite to enhance its high temperature resistance. This type of material is commercially available and in one form, known as tadpole material, available from Pyrotek, Inc. of Spokane, Wash., is made with a projecting flap 72 of fabric as shown in FIG. 7. A specifically suitable material is sold under the brand name PYROTEK H-10B. This material is typically used to seal furnace doors and the like. The gasket is preferably detachably mounted to the plate 35. For example, a clamp or retainer secured by mechanical fasteners to the plate may be used to support the gasket in position. As shown in FIG. 7, in one form the retainer comprises an annular ring or rim 74 which sandwiches the fabric flap 72 between the working surface 64 of the plate and the rim. A plurality of bolts 76 are used to detachably secure the rim 74 in place and clamp the gasket to the vacuum hood.

The tadpole gasket material is resistant to temperatures of up to 1500° F. Of course, other gasket material and clamping mechanisms maybe used, with mechanical clips, stacked padding, or high temperature resistant fabric coated gasket materials being suitable examples.

To accommodate the unevenness of sows, and without requiring special manufacturing steps to carefully control the evenness of the upper surface of a sow, gaskets with an initial diameter of at least one and one-half inches, and preferably two inches, are suitable for sows with typical surface variations of from about one-quarter to about three-quarters of an inch from a plane. Thicker gaskets may also be used. During use, these gaskets are compressed from their initial circular configuration to almost a flat configuration, but still provide an effective seal between the exposed sow surface 51 and the working surface 64 of the vacuum hood. Although shown as a bolt width a head in FIG. 7, most preferably flathead bolts are used as fasteners 76 such that the heads are flush with the lower surface of the rim 74.

Figure 5:
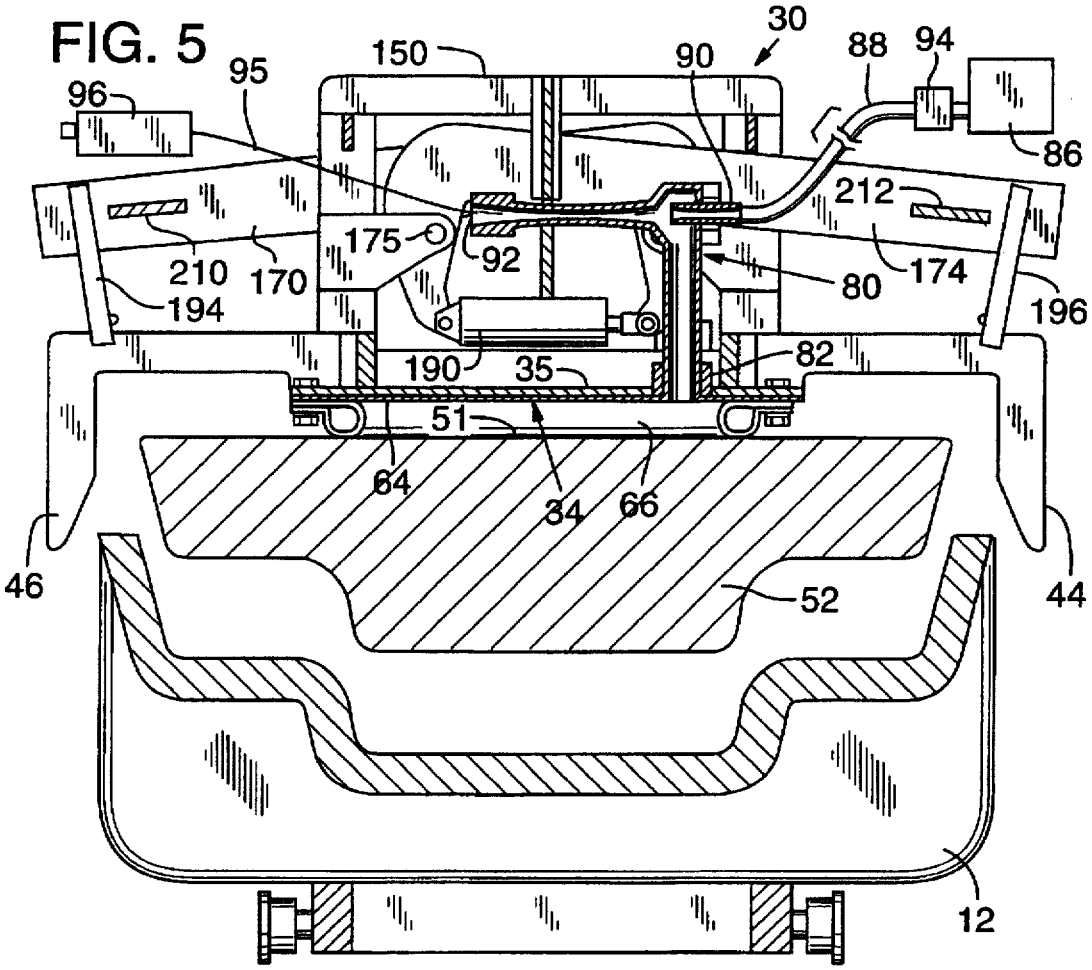
FIG. 5 is a vertical sectional view, partially in schematic form, taken along lines 5—5 of FIG. 3 and which illustrates a jet pump for establishing a vacuum between the working surface of a vacuum hood and a supported sow and which also illustrates a mold of a sow train in simplified form.

Upon bringing the vacuum hood 34 and gasket 66 into sealing contact with the upper surface 51 of the sow 52, a vacuum is drawn between the working surface and sow. Any suitable mechanism may be utilized to establish the vacuum, such as a conventional vacuum pump. However, in the most preferred form of the invention, an aspirator or jet pump 80, FIG. 5, is used for this purpose. One suitable pump is a Penberthy Model GH-2 jet pump from Penberthy of Prophetstown, Ill. Such pumps have heretofore been muffled and used in an aluminum production facility of Columbia Aluminum Corporation in Goldendale, Wash., to create a vacuum in a tank for drawing molten aluminum into the tank.

As shown in FIG. 5, the jet pump 80 is coupled to a port 82 in the vacuum hood 34 and communicates with the space between the working surface 64 of the vacuum hood plate 35 and the upper surface 66 of a sow to be lifted. Pressurized air from a source 86 is delivered by way of a hose 88 to an inlet 90 of the jet pump 80 whenever a valve 94 is opened. The valve 94 may be manually and/or remotely controlled, and in the case of an automatic system, would be typically electronically controlled. As air travels through the jet pump from the inlet 90 to an outlet 92, a vacuum is drawn between the working surface 64 of vacuum hood plate 35 and the upper surface 66 of the sow. Air exiting the outlet 92 passes through a coupling 95 and an optional muffler 96, indicated schematically in FIG. 5, to reduce the noise of the jet pump. As a specific example, air available in a manufacturing plant may enter the inlet 90 to the jet pump 80 at 125 cubic feet per minute. A resultant vacuum of from about 13 inches to about 15 inches of mercury is generated in the gap between the working surface 64 and upper surface 51 of the sow when the working surface area bounded by the gasket is about 850 square inches. Pursuant to industrial standards, a minimum of about seven inches of mercury would be required to safely lift an object of about 1500 pounds.

Referring again to FIGS. 2–4, the port 82 is shown. In addition, in FIG. 3, a vacuum monitoring port 100 is also illustrated to which an optional gauge (not shown) may be connected to monitor the vacuum established between the vacuum hood and sow during lifting.

A reinforcing frame is also coupled or mounted to the vacuum hood. The illustrated frame includes an upright generally trapezoidal flange 110 (FIG. 2) having a generally rectangular opening 112 provided through the center thereof. The opening 112 accommodates the jet pump which extends partially through the opening from port 82. In addition, flange 110 includes an aperture 114 to which a hook or other coupling to a hoist, not shown in FIG. 3, may be connected for use in raising and lowering the vacuum hood into and out of the sow lifting position. Cross braces, shown only in FIG. 3, and indicated by numbers 115, 116, 118, 120, extend from the upper surface of the vacuum hood 34 to an upper central portion of the flange 110 to rigidify the flange 110.

The frame may also include a gripping element support for carrying a sow gripper, one form of sow gripper being indicated generally at 130 in FIGS. 2–4. In general, the sow gripper comprises a mechanical assembly which is shiftable between a first or sow gripping position wherein gripping elements are positioned at least partially beneath a supported sow and a second or sow release position in which the gripping elements are not disposed at least partially beneath the sow. When in the first or sow gripping position, the gripping elements engage the sow to support the sow either alone or in combination with the vacuum lifting force. The sow gripper may be utilized as an auxiliary or safety mechanism to catch a sow and prevent it from falling in the event the vacuum is inadvertently relieved, such as upon failure of the air supply to a jet pump or failure of the vacuum establishing seal. Alternatively, the sow gripper may be utilized as the primary apparatus for supporting a sow as it is lifted by the vacuum lifter from a mold. Most typically, the vacuum lifting force is maintained throughout the entire sow lifting operation and the sow gripper also operates as the sow is lifted free from the mold to grip the sow.

Although the sow gripping assembly may take other forms, in the preferred embodiment, the assembly includes a support which, in the illustrated form, comprises first and second inverted generally U-shaped support brackets 150, 152 extending upwardly from the upper surface of the vacuum hood 34. The brackets 150, 152 are positioned in a parallel spaced apart relationship with each of the brackets being positioned adjacent to a respective end of the vacuum hood. As best seen in FIG. 4, the brackets 150 include projecting ear flanges 160, 162 extending inwardly relative to the periphery of the vacuum hood 34, and above the vacuum hood, from the respective upright legs 164, 166 of the bracket 150. The upper ends of legs 164, 166 are interconnected by a cross piece 168. Similar ear flanges, not numbered, are coupled to the bracket 152.

A first gripping arm 170 is pivoted at 173 to the flange 160. As best seen in FIG. 4, arm 170 extends outwardly beyond the side peripheral edge of the vacuum hood 34. In addition, a second arm 174 is pivoted at 175 to the flange 162. The arm 174 extends outwardly beyond the side peripheral edge of the vacuum hood 34 in a direction generally opposite to the direction of projection of the arm 170. Arm 170 includes a lever section 180 projecting downwardly below pivot point 173 while arm 174 includes a lever section 182 projecting downwardly below pivot point 175. Levers 180, 182 form a portion of one form of an actuator which also includes a fluid cylinder 190 operable in response to hydraulic or other fluid pressure, and most preferably air pressure, to extend and retract. Arm 170 includes a downwardly projecting sow engaging or gripping element or finger 194. Similarly, arm 174 includes a downwardly projecting sow engaging element or finger 196. These fingers may include an optional sow contacting projection, not numbered in these figures, which extends from the fingers and toward the sow. As best seen in FIG. 3, the respective arms 170, 174 are bent so as to extend away from the supporting bracket 150 to clear the supporting bracket during operation of the sow gripper. Webs 200, 202 reinforce the respective arms 170, 174 at the locations where they are bent.

Similar elements are connected to the bracket 152 and are not discussed as their understanding is readily apparent from the above discussion. However, for purposes of clarification, the arm and gripping element coupled to bracket 152 and which correspond to elements 170, 194 are labeled with the numbers **170*a* and 194*a*. In addition, the arm and gripping element coupled to bracket 152 and which correspond to arm 174 and gripping element 196 are labeled with the numbers 174*a* and 196*a***.

A rigid link 210 interconnects arms 170 and **170*a*. A similar rigid link 212 interconnects arms 174 and 174*a*. Operation of the cylinders simultaneously operates each of the arms 170, 170*a*, 174 and 174*a* together with their corresponding gripping elements 194, 194*a*, 196 and 196*a***.

Figure 6:
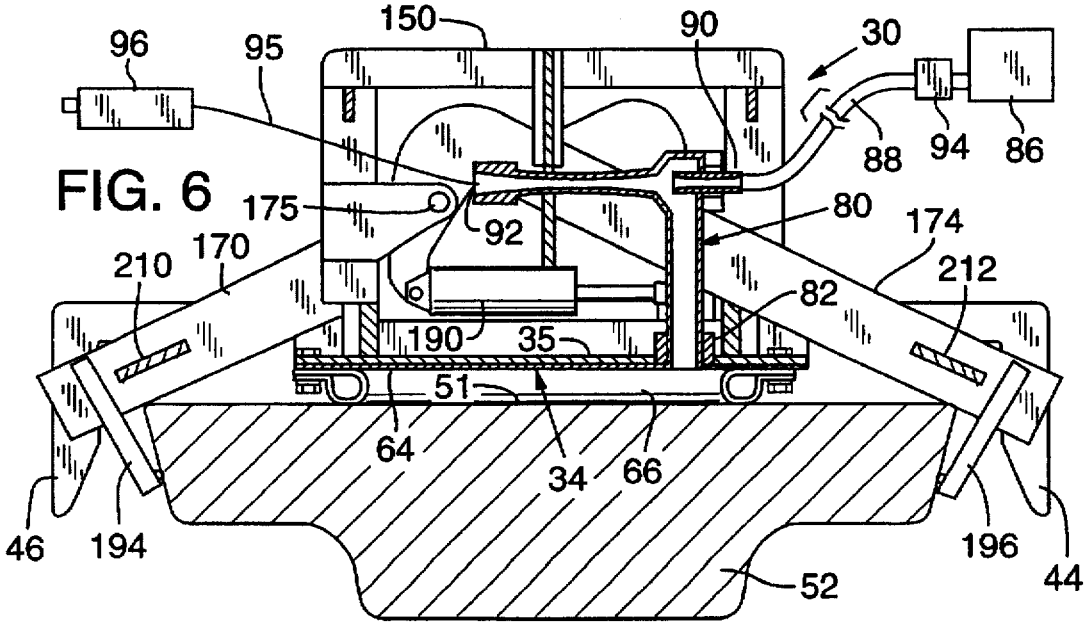
FIG. 6 is a vertical sectional view similar to that of FIG. 5 with FIG. 6 showing sow gripping elements in a sow gripping position in contrast to being shown in FIG. 5 in a sow release position.

As can be seen in FIG. 5, with cylinder 190 retracted, arm 174 is pivoted clockwise relative to pivot 175, while arm 170 is pivoted counter-clockwise relative to its pivot 173 (not shown in FIG. 5) so that the arms 170, 174 are in their raised position and the sow gripping elements 194, 196 are in a release position away from the sow, that is not underneath any portion of the sow. In the preferred embodiment, the fluid cylinders are pressurized to shift the gripping elements to the release position. When in this position, the sow lifter may be lowered against the upper surface of the sow without interference by the sow gripping assembly 30. In contrast, as shown in FIG. 6, as the sow is lifted free of the mold or car 12, cylinder 190 extends as shown. Consequently, arms 170, 174 pivot to their lower positions. When in these lowered positions, the sow gripping elements 194, 196 engage the beveled side surfaces of a sow and will maintain the sow in its lifted position in the event vacuum is inadvertently or intentionally relieved between the working surface 64 of vacuum hood plate 35 and the upper surface 66 of the sow. As best seen in FIG. 6, the illustrated sow 52 has side surfaces which converge inwardly moving from top to bottom of the sow. Consequently, the sow gripping elements 194, 196 are not only positioned partially beneath the sow when in the sow gripping position shown in FIG. 6, but are also positioned inwardly of the outer periphery of the uppermost surface 51 of the sow so that the sow cannot fall.

In the preferred embodiment, the cylinders are relieved of pressure and allowed to extend. Most preferably, this occurs simultaneously with the application of the vacuum drawing air supply to the vacuum hood. The weight of the arms 170, 170*a*, 174, 174*a* under the influence of gravity extends the cylinder. As the sow clears the mold, the sow engaging elements fall into contact with the side surfaces of the sow. The arms thereafter remain in this position until such time as the lifted sow is deposited on a surface, such as a sow stack, to relieve the pressure on the sow engagement elements. The cylinders are then pressurized to raise the sow gripper to the release position. With this approach, the sow gripper functions even if fluid pressure to the vacuum hood and cylinders fails. Although less preferred, the sow gripper could be designed for positive movement in response to a pressurized extension of the sow gripping cylinders.

Figure 8:
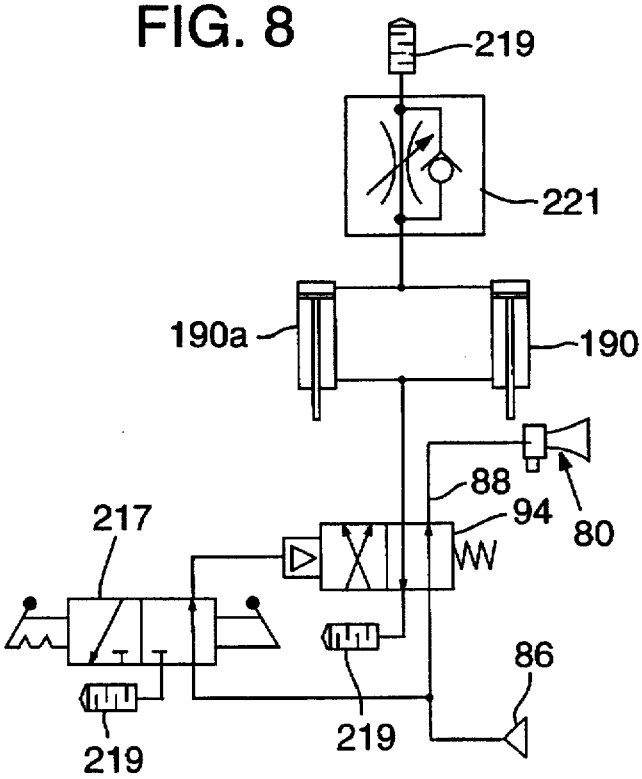
FIG. 8 is a schematic diagram of a suitable pneumatic circuit usable in the present invention.

Referring to FIG. 8, a suitable pneumatic system in the illustrated embodiment utilizes a two-position, four-way valve as valve 94. When valve 94 is shifted to the position shown in FIG. 8, for example in response to a manually activated pilot valve 217, air from air supply 86 is delivered to jet pump 80 to draw the vacuum at the sow lifter working surface. Simultaneously, cylinders 190, 190*a* are relieved of air pressure to allow the gripper arms to fall under the influence of gravity. The valve 94 is typically shifted to this position as the sow lifter is brought into contact with a sow to be lifted. In the event the pilot valve 217 is activated to shift the valve 94 to the opposite position from that shown in FIG. 8, the air supply to the jet pump 80 is shut off and air is supplied to the cylinders 190, 190*a* to retract the cylinders and raise the gripper arms. However, if a sow is still gripped at this time, the cylinders do not overcome the weight applied by the sow to the gripper arms and the sow remains gripped. After the sow is deposited onto a floor or other surface, thereby relieving the weight on the gripping arms, the cylinders 190, 190*a*, assuming air pressure is still being supplied to them, retract and raise the gripping arms in preparation for the next sow lifting cycle. Mufflers 219 are attached to the pneumatic outlets in this system for noise control purposes. Also, a conventional flow controller 221 limits the rate at which the cylinders 190, 190*a* retract when supplied with air under pressure.

Referring again to FIGS. 2, 3 and 4, the guides 40–50 are shown in greater detail. These guides in the illustrated form are generally L-shaped with a first leg which projects outwardly from the vacuum hood and a second downwardly projecting leg which extends below the working surface 64 of the vacuum hood. As best seen in FIG. 5 in connection with guides 44, 46, as the sow lifter is lowered into position, the guides straddle the outer periphery of the car 12 to effectively center the vacuum hood 34 at the desired position above the sow. As also can be seen in FIG. 5, the legs 44, 46 are beveled and diverge toward their distal ends to thereby increase the distance between the lower-most portions of the guides. The beveled surfaces of the guides assist in centering the sow lifter in the desired position as the sow lifter is lowered. Although not shown, guides 40 and 42 are preferably similarly tapered or beveled.

In the case of a manual system, a handle 220 is provided between legs 48 and 50. In this case, a worker may grab handle 220 to assist in guiding the sow lifter into position over the sow. By suspending the sow from a single hook or other pivot, the sow may be freely pivoted about the axis of the supporting hoist until the guides are in the desired position. However, the sow lifter may also be mounted in a fixed rotational position relative to cars in a sow train if desired, for example in an automatic or semi-automatic system. In addition, the sow lifter may be pivoted with a supported sow to the desired orientation at the sow collection location.

In operation, the sow lifter is positioned above the sow removal location. When a car 12 containing a solidified sow arrives at the sow removal location 18 (FIG. 1), the sow lifter is lowered and guided until the gasket engages the upper surface 51 of the sow and establishes a seal between the working surface 64 of the vacuum hood 34 and the sow. Valve 94 is operated during this process to establish a vacuum in the space between working surface 64 and the sow to thereby establish a vacuum connection between the sow lifter and sow. The sow lifter is then raised to lift the sow from the mold. In addition, as the sow clears the mold, the cylinder 190 is allowed to extend to the position shown in FIG. 6 such that the sow gripper grips the sow. Subsequently, the sow lifter and supported sow are moved to the sow collection location. At this location, the sow lifter is lowered. The sow gripper is released and the vacuum is relieved to deposit the sow at the collection location. The cycle is then repeated to remove another sow from the a mold, such as from a sow train.

Having illustrated and described the principles of our invention with respect to a preferred embodiment, it should be apparent to those of ordinary skill in the art that our invention may be modified in arrangement and detail without departing from such principles. We claim all such modifications which fall within the scope of the following claims.

We claim:

1. A sow lifter for lifting a sow from a mold comprising:

a vacuum hood having a lower working surface;

a high temperature resistant compressible gasket mounted to the vacuum hood in a position to establish a seal between the lower working surface of the hood and a sow which is to be lifted when the vacuum hood is moved to a sow lifting position, the gasket having a core and a fabric material covering the core;

a vacuum hood mover coupled to the vacuum hood and operable to move the hood to the sow lifting position and to a second position in which the sow is lifted from the mold;

whereby drawing a vacuum in the vacuum hood when the vacuum hood is in the sow lifting position releasably couples the sow to the hood for lifting the sow from the mold as the vacuum hood is moved to the second position by the vacuum hood mover; and a sow gripper coupled to the vacuum hood and selectively shiftable from a first sow gripping position at least partially beneath a sow which has been lifted from the mold and held in a lifted position by the drawing of the vacuum to a second release position in which the sow gripper is not positioned beneath the sow, whereby when in the first sow gripping position the sow gripper is in a position to support the sow.

2. A sow lifter according to claim 1 including a jet pump coupled to the vacuum hood and operable to establish the vacuum between the working surface and the sow to be lifted.

3. A sow lifter according to claim 1 in which the gasket prior to use has a circular cross section with a diameter of at least one and one-half inches.

4. A sow lifter according to claim 1 in which the gasket is detachably mounted to the vacuum hood.

5. A sow lifter according to claim 1 in which the core is a fiberglass rope and the fabric material is of graphite coated fiberglass.

6. A sow lifter according to claim 1 including guides projecting outwardly and downwardly relative to the vacuum hood.

7. A sow lifter according to claim 1 in which the sow gripper comprises plural sow gripping arms pivotally coupled to the vacuum hood and an actuator coupled to the arms and operable to control the pivoting of the arms between the first position at least partially beneath the sow and the second position not positioned beneath the sow.

8. A sow lifter according to claim 7 in which the actuator includes a respective lever coupled to each arm, the actuator also including a fluid actuated cylinder coupled to the lever, the cylinder being extendable and retractable in response to fluid pressure and being operable to control the pivoting of the lever and shifting of the arm between the first and second positions.

9. A sow lifter according to claim 8 in which the vacuum hood mover includes a hoist coupled to the vacuum hood.

10. A sow lifter according to claim 1 in which the actuator permits the arms to pivot under the influence of gravity to the first sow gripping position.

11. A sow lifter for lifting a sow from a mold comprising:

a vacuum hood having a lower working surface;

a high temperature resistant gasket coupled to the vacuum hood in a position to establish a seal between the lower working surface and a sow during lifting of the sow;

a vacuum source operable to establish a sufficient vacuum between the lower working surface and the sow such that upward movement of the vacuum hood lifts the sow from the mold; and a sow gripper coupled to the vacuum hood and shiftable from a first sow gripping position at least partially beneath a sow lifted as a result of the applied vacuum from the mold to a second release position in which the sow gripper is not positioned beneath the sow, whereby when in the first sow gripping position the sow gripper is in a position to support the sow in combination with the support provided by the vacuum hood as a result of the applied vacuum.

12. A sow lifter for lifting a sow from a mold according to claim 11 in which the sow gripper comprises plural sow gripping arms pivotally coupled to the vacuum hood and an actuator coupled to the arms and operable to control the pivoting of the arms to the first position at least partially beneath the sow and the second position not positioned beneath the sow, the actuator including a respective lever coupled to each arm and a fluid actuated cylinder coupled to the lever, the cylinder being extendable and retractable in response to fluid pressure to control the pivoting of the lever and shifting of the arm between the first position at least partially beneath the sow and the second position not beneath the sow.

13. A sow lifter for lifting a sow from a mold according to claim 11 in which the actuator permits the arms to pivot under the influence of gravity to the first sow gripping position.

14. A sow lifter according to claim 11 in which the gasket is detachably mounted to the vacuum hood.

15. A sow lifter for lifting sows from a mold comprising:

a vacuum hood having a lower working surface;

a high temperature resistant compressible gasket detachably mounted to the vacuum hood in a position to establish a seal between the lower working surface and a sow which is to be lifted when the vacuum hood is moved to a sow lifting position, the gasket including a graphite coated material;

a vacuum hood mover coupled to the vacuum hood and operable to move the hood to the sow lifting position and to a second position in which the sow is lifted from the mold;

whereby drawing a vacuum between the working surface and the sow when the vacuum hood is in the sow lifting position releasably couples the sow to the vacuum hood for lifting the sow from the mold as the vacuum hood is moved to the second position by the vacuum hood mover;

the sow lifter including a jet pump coupled to the vacuum hood which is operable to establish the vacuum in the vacuum hood;

a sow gripper coupled to the vacuum hood and shiftable from a first position at least partially beneath a lifted sow to a second position in which the sow gripper is not positioned beneath the lifted sow, whereby when in the first position the sow gripper supports the sow, the sow gripper comprising plural sow gripping arms pivotally coupled to the vacuum hood and an actuator coupled to the arms and controlling the pivoting of the arms; and the actuator including a respective lever coupled to each arm, the actuator also including a fluid actuated cylinder coupled to the lever, the cylinder being extendable and retractable in response to fluid pressure and being operable to allow the arm to pivot to the sow gripping position under the influence of gravity.

16. A sow lifter according to claim 15 including a frame which supports the vacuum hood, the frame including projecting guide elements which extend outwardly and downwardly relative to the vacuum hood.

17. A sow lifter according to claim 16 including a muffler coupled to the jet pump.

18. A sow lifter according to claim 16 in which the vacuum hood mover includes a motor operated hoist coupled to the sow lifter for raising and lowering the sow lifter.

19. A sow lifter according to claim 15 in combination with a sow train comprising a plurality of traveling molds, the molds being filled with molten metal at one first location and the sow lifter being operable to remove a solidified metal sow from a mold when the mold travels to a sow removal location.

* * * * *